US011142977B2

(12) United States Patent
Nguyen et al.

(10) Patent No.: US 11,142,977 B2
(45) Date of Patent: Oct. 12, 2021

(54) ELECTRICALLY CONTROLLED PROPELLANT IN SUBTERRANEAN OPERATIONS AND EQUIPMENT

(71) Applicant: Halliburton Energy Services, Inc., Houston, TX (US)

(72) Inventors: Philip D. Nguyen, Houston, TX (US); Norman R. Warpinski, Cypress, TX (US); Vladimir Nikolayevich Martysevich, Spring, TX (US); Ronald Glen Dusterhoft, Katy, TX (US); Harold Grayson Walters, Tomball, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 16 days.

(21) Appl. No.: 16/337,281

(22) PCT Filed: Oct. 27, 2016

(86) PCT No.: PCT/US2016/059152
§ 371 (c)(1),
(2) Date: Mar. 27, 2019

(87) PCT Pub. No.: WO2018/080500
PCT Pub. Date: May 3, 2018

(65) Prior Publication Data
US 2020/0032601 A1 Jan. 30, 2020

(51) Int. Cl.
*E21B 23/04* (2006.01)
*E21B 23/06* (2006.01)
(Continued)

(52) U.S. Cl.
CPC ..... *E21B 23/04* (2013.01); *C06B 25/34* (2013.01); *C06B 31/30* (2013.01); *E21B 23/065* (2013.01); *E21B 23/00* (2013.01)

(58) Field of Classification Search
CPC . E21B 23/04; E21B 23/06; F42D 1/04; F42D 1/045; F42D 1/05
See application file for complete search history.

(56) References Cited

U.S. PATENT DOCUMENTS 4,498,543 A 2/1985 Pye et al.
5,024,270 A * 6/1991 Bostick ..... E21B 23/065 160/120
(Continued)

FOREIGN PATENT DOCUMENTS

WO 02/06629 A1 1/2002

OTHER PUBLICATIONS

Debra Werner, Spotlight: Digital Solid State Propulsion, Sep. 24, 2012, Spacenews (Year: 2012).*
(Continued)

*Primary Examiner* — Robert E Fuller
*Assistant Examiner* — Lamia Quaim
(74) *Attorney, Agent, or Firm* — Thomas Rooney; Baker Botts L.L.P.

(57) ABSTRACT

Systems and methods using electrically controlled propellant to operate equipment in subterranean formations are provided. In some embodiments, the methods comprise: providing a tool assembly that comprises a tool body and an electrically controlled propellant; and placing the tool assembly in at least a portion of a subterranean formation. Electrical current may be applied to at least a portion of the electrically controlled propellant to ignite the portion of the propellant to operate a portion of the tool assembly.

20 Claims, 6 Drawing Sheets

(51) Int. Cl.

| | |
|---|---|
| ***E21B 23/00*** | (2006.01) |
| ***C06B 25/34*** | (2006.01) |
| ***C06B 31/30*** | (2006.01) |

(56) References Cited

U.S. PATENT DOCUMENTS

| | | | | |
|---|---|---|---|---|
| 5,265,678 | A | 11/1993 | Grundmann | |
| 5,346,015 | A | 9/1994 | Grundmann | |
| 5,392,860 | A * | 2/1995 | Ross | E21B 23/065 102/222 |
| 6,237,688 | B1 * | 5/2001 | Burleson | E21B 29/02 166/281 |
| 6,634,429 | B2 | 10/2003 | Henderson et al. | |
| 7,073,581 | B2 | 7/2006 | Nguyen et al. | |
| 7,152,678 | B2 | 12/2006 | Turner et al. | |
| 7,971,646 | B2 | 7/2011 | Murray et al. | |
| 8,317,952 | B2 | 11/2012 | Katzakian et al. | |
| 8,607,704 | B2 | 12/2013 | Stark et al. | |
| 8,617,327 | B1 | 12/2013 | Katzakian et al. | |
| 8,888,935 | B2 | 11/2014 | Grix et al. | |
| 8,931,553 | B2 | 1/2015 | Cannan et al. | |
| 8,944,171 | B2 | 2/2015 | Parrott et al. | |
| 9,182,207 | B2 | 11/2015 | McPherson et al. | |
| 9,234,412 | B2 | 1/2016 | Getzlaf et al. | |
| 2003/0070811 | A1 | 4/2003 | Robison et al. | |
| 2004/0040707 | A1 | 3/2004 | Dusterhoft et al. | |
| 2007/0240880 | A1 | 10/2007 | Olsen | |
| 2013/0327455 | A1 * | 12/2013 | Katzakian | C06B 27/00 149/45 |
| 2014/0338905 | A1 | 11/2014 | Ersoz et al. | |
| 2015/0107830 | A1 | 4/2015 | Ersoz et al. | |
| 2015/0354337 | A1 | 12/2015 | Ersoz et al. | |

OTHER PUBLICATIONS

International Search Report and Written Opinion issued in related PCT Application No. PCT/US2016/059152 dated Jul. 25, 2017, 16 pages.

* cited by examiner

ELECTRICALLY CONTROLLED PROPELLANT IN SUBTERRANEAN OPERATIONS AND EQUIPMENT

CROSS-REFERENCE TO RELATED APPLICATION

The present application is a U.S. National Stage Application of International Application No. PCT/US2016/059152 filed Oct. 27, 2016, which is incorporated herein by reference in its entirety for all purposes.

BACKGROUND

The present disclosure relates to systems and methods for performing subterranean operations.

Numerous different types of tools and equipment are used in operations in subterranean formations. For example, in order to isolate certain portions of a well bore drilled to penetrate a subterranean formation, devices such as packers, plugs, or valves may be installed in the well bore that can obstruct and/or control the flow of fluids into or out of the well bore. Tubulars such as liners, casings, and the like also may be installed in a well bore penetrating a subterranean formation, among other reasons, to provide a path for treatment fluids or other fluids to be introduced into the formation and/or to provide a path for fluids such as oil, gas, water, or other fluids to flow out of the formation. Such tubulars must have openings or perforations in certain locations in order to allow fluids to flow into and out of those tubulars where desired. Explosive charges and perforating guns are sometimes used to create those perforations. However, many such charges and guns may prevent safety risks in their transportation and/or use downhole. In some instances, pre-perforated tubulars already having holes or perforations created therein may be installed in a well bore, with the holes or perforations plugged or filled until fluid flow is desired.

The tools described above generally must be actuated or manipulated in the well in the course of their use. For example, a packer or plug must usually be "set" in the well bore in order to secure it in the desired location. Many such tools have a setting mechanism of some sort that must be manipulated to set or lock the tool in position. In the case of the pre-perforated tubular, the plugs or filling material in the pre-made holes or perforations must be removed in order to allow fluid to flow therethrough. However, these tools are often installed or positioned far below the surface in the well bore when these actuations must occur, and thus energy in the form of electricity or hydraulic power must be provided to those downhole locations, often via cables, wires, or other equipment run from the surface and into the well bore. However, the efficient delivery of energy from the surface to locations in a subterranean formation far below the surface using these types of equipment may be difficult, particularly when the equipment must be run down a well bore that may be of limited diameter.

BRIEF DESCRIPTION OF THE DRAWINGS

These drawings illustrate certain aspects of some of the embodiments of the present disclosure, and should not be used to limit or define the claims.

Figure 1A:
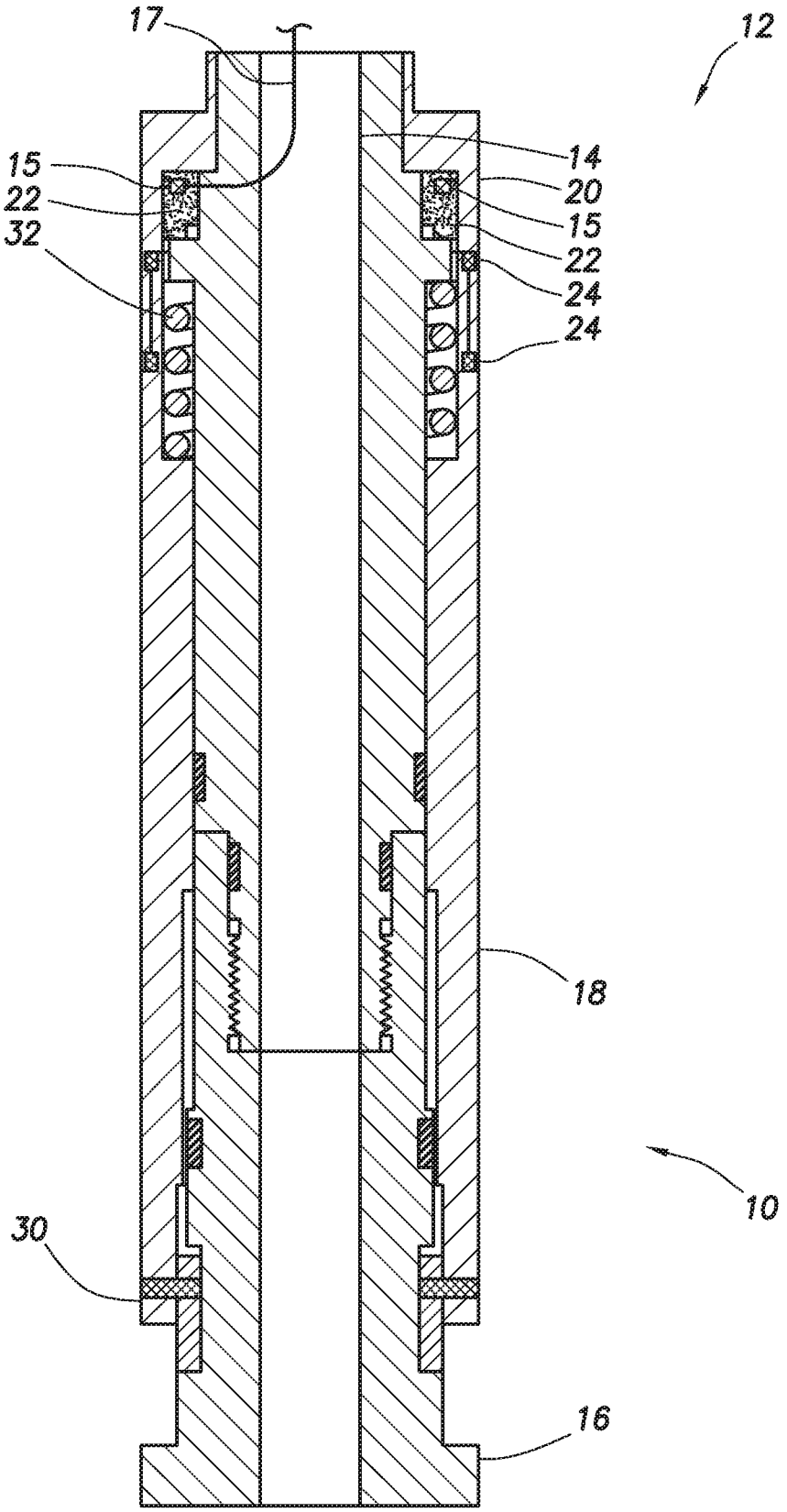
FIG. 1A is a diagram showing a side cross-sectional view of a tool according to certain embodiments of the present disclosure.

While embodiments of this disclosure have been depicted, such embodiments do not imply a limitation on the disclosure, and no such limitation should be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DESCRIPTION OF CERTAIN EMBODIMENTS

The present disclosure relates to systems and methods for performing subterranean operations. More particularly, the present disclosure relates to systems and methods using electrically controlled propellant to operate equipment in subterranean formations.

The present disclosure provides methods and systems involving mechanical equipment for subterranean operations in which an electrically controlled propellant is used to operate certain aspects of that equipment. The electrically controlled propellants used in the present disclosure are substances that can be ignited by passing an electrical current through the propellant, which produces energy, gas, or other by-products. In certain embodiments, the systems of the present disclosure comprise a tool assembly that comprises at least one actuatable mechanical component and an electrically controlled propellant that, when ignited, provides a source of energy that is used to actuate the mechanical component. In other embodiments, the systems of the present disclosure may comprise a pre-perforated sub that comprises a plurality of perforations disposed in the tool body, wherein one or more of the perforations are at least partially filled with a filler composition that comprises the electrically controlled propellant. In these embodiments, when the propellant is ignited, the propellant may be at least partially consumed and the perforations may become opened, which may permit the flow of fluid through those perforations. The methods of the present disclosure involve placing and/or using such systems in at least a portion of a subterranean formation.

Among the many potential advantages to the methods and compositions of the present disclosure, only some of which are alluded to herein, the methods, compositions, and systems of the present disclosure may facilitate the use of certain downhole tools or equipment requiring energy for their operation without large amounts of power (e.g., electricity, hydraulic power, etc.) transmitted from the surface. This may alleviate the need for certain power transfer equipment in certain downhole well systems, making their designs more streamlined. In certain embodiments, the ignition of the electrically controlled propellants used in the methods and systems of the present disclosure may be more effectively controlled as compared to other types of propellants, fuels, or explosives. For example, these electrically controlled propellants may be less likely to spontaneously ignite, particularly at elevated pressure and/or temperature conditions experienced downhole. For these and other reasons, the methods and systems of the present disclosure may present fewer or smaller safety risks in their transportation, handling, and use than certain conventional methods and systems. Moreover, in some embodiments, it may be possible to cease the ignition of an electrically controlled propellant (e.g., by discontinuing the flow of electrical current therethrough), and then re-ignite the remaining portion of that same propellant at a subsequent time (e.g., by re-applying electrical current to it). Consequently, in some embodiments, the methods and systems of the present disclosure may provide equipment that can be used or actuated repeatedly (either in the same subterranean formation or in a different formation) without replacing the actuating component or energy source therein.

The electrically controlled propellants of the present disclosure may comprise any substance known in the art that can be ignited by passing an electrical current through the propellant. The electrically controlled propellant may be provided in any form, including solids (e.g., powders, pellets, etc.), liquids, gases, semi-solids (e.g., gels), and the like. In some embodiments, the electrically controlled propellant may be provided in a composition that comprises a mixture of one or more electrically controlled propellants and other materials, including but not limited to inert materials such as sand, cement, fiberglass, ceramic materials, carbon fibers, polymeric materials, clay, and the like. In certain embodiments, the electrically controlled propellant may comprise a binder (e.g., polyvinyl alcohol, polyvinylamine nitrate, polyethanolaminobutyne nitrate, polyethyleneimine nitrate, copolymers thereof, and mixtures thereof), an oxidizer (e.g., ammonium nitrate, hydroxylamine nitrate, and mixtures thereof), and a crosslinking agent (e.g., boric acid). Such propellant compositions may further comprise additional optional additives, including but not limited to stability enhancing or combustion modifying agents (e.g., 5-aminotetrazole or a metal complex thereof), dipyridyl complexing agents, polyethylene glycol polymers, and the like. In certain embodiments, the electrically controlled propellant may comprise a polyalkylammonium binder, an oxidizer, and an eutectic material that maintains the oxidizer in a liquid form at the process temperature (e.g., energetic materials such as ethanolamine nitrate (ETAN), ethylene diamine dinitrate (EDDN), or other alkylamines or alkoxylamine nitrates, or mixtures thereof). Such propellants may further comprise a mobile phase comprising at least one ionic liquid (e.g., an organic liquid such as N,n-butylpyridinium nitrate). Certain of the aforementioned propellants may be commercially available from Digital Solid State Propulsion, Inc. of Reno, Nev.

The tool assemblies of the present disclosure may comprise any type of downhole tool or equipment known in the art that is used in subterranean operations. In some embodiments, the tool assembly may comprise one or more mechanically actuatable parts that require an energy source to operate them. Examples of types of such tools or equipment include but are not limited to, packers, plugs, valves (e.g., inflow control valves, downhole or subsurface safety valves, etc.), blow out preventers, sliding sleeves, downhole motors, and the like. These tools may be made of any suitable material used in the art, whether metal or non-metallic. In these embodiments, the ignition of the electrically controlled propellant may release energy (e.g., in the form of heat) or gas that causes one or more mechanical components of the tool to be actuated. In some embodiments, the electrically controlled propellant may be used in combination with other energy sources (either at the surface or downhole) to actuate the mechanical components of the downhole tool.

The electrically controlled propellant can be installed or otherwise placed in a tool assembly of the present disclosure using any technique or method known in the art. In some embodiments, the electrically controlled propellant may be provided as a solid or in a container that is simply installed in the tool in a location such that it can provide the energy to the mechanically actuatable component when ignited. In some embodiments, the electrically controlled propellant may be placed on a surface in the tool assembly via a "printing" or "painting" method, whereby the electrically controlled propellant is provided as or dissolved in a liquid that is applied to a surface in the tool assembly. As noted above, in some embodiments, the electrically controlled propellant may be provided in a composition that comprises a mixture of one or more electrically controlled propellants and other materials, including but not limited to sand, cement, fiberglass, ceramic materials, carbon fibers, polymeric materials, clay, and the like.

Figure 1B:
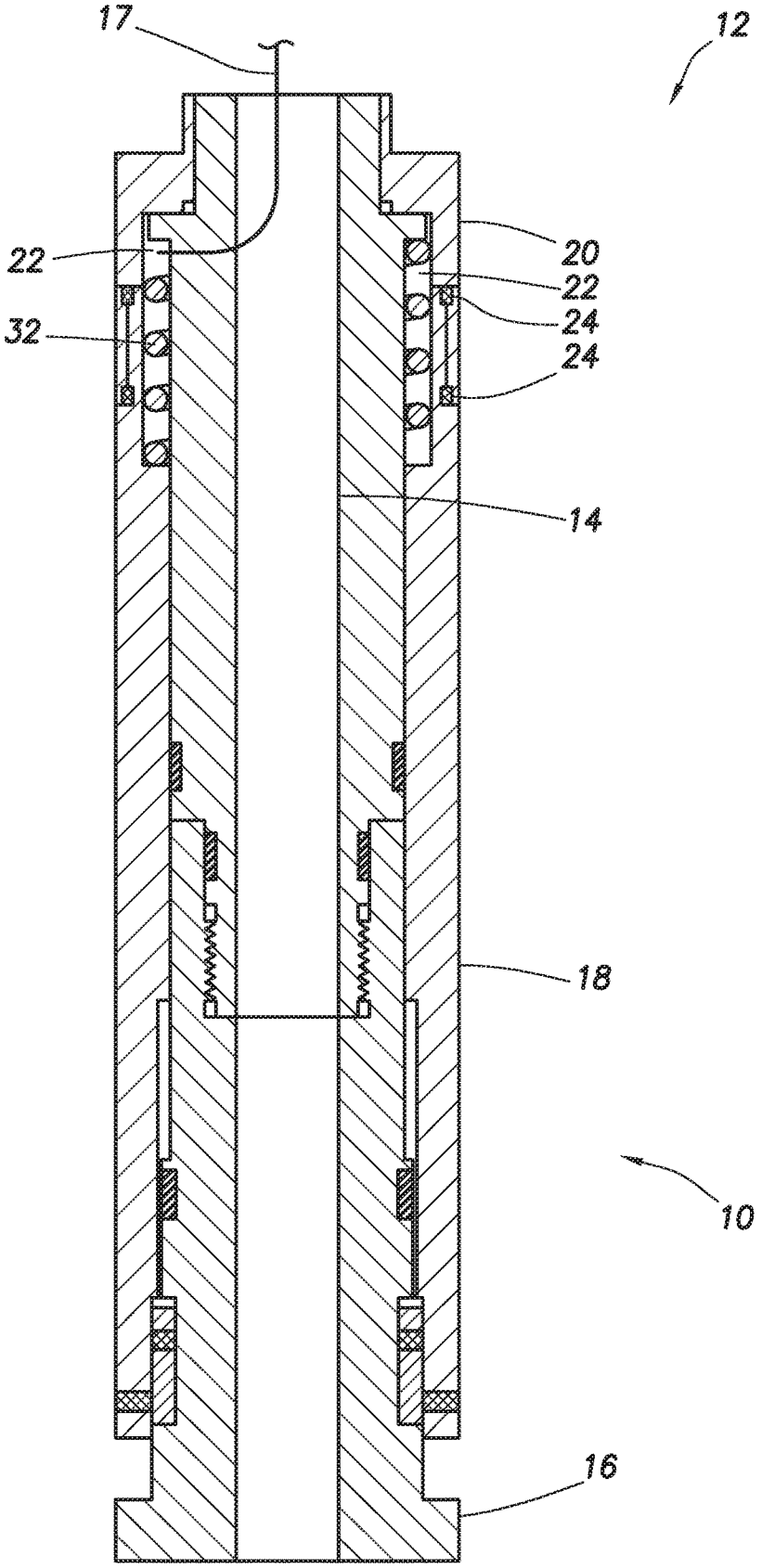
FIG. 1B is a diagram showing a side cross-sectional view of the tool shown in FIG. 1A, showing an unlocked position.

An example of a tool of the present disclosure that includes an electrically-controlled propellant and one or more mechanically actuatable parts that can be operated in this manner is shown in FIGS. 1A and 1B. Referring now to FIG. 1A, a tool 12 is shown that comprises a mandrel 14 and a locking slot assembly 10. The locking slot assembly 10 is positioned adjacent to a lower end of the tool in the embodiment shown, although in other embodiments the locking slot assembly may be disposed in any location on the tool. Tool 12 may connect to a tool string (not shown) and the entire tool string may be positioned in a well bore. This tool may be any kind of tool known in the art, such as a valve, packer, plug, or any other type of tool that can be configured in different positions. Locking slot assembly 10 is illustrated below the tool 12. Tool 12 may include, or be attached to, an inner, actuating mandrel 14, which may be connected to the tool string. Locking slot assembly may include the actuating mandrel 14, attached at a lower end to bottom adapter 16. Actuating mandrel 14 and at least a portion of bottom adapter 16 may be situated within a fluid chamber case 18 and/or a lock 20. The fluid chamber case 18 and the lock 20 may be removably attached, fixedly attached, or even integrally formed with one another. Alternatively fluid chamber case 18 and lock 20 may be separate.

At least one fluid chamber 22 may be situated between actuating mandrel 14 and lock 20. Fluid chamber 22 may be sealed via one or more seals 24, along with one or more shear pins 30 situated in the lock 20 that prevent the lock 20 from moving. A spring 32 may be included to keep the locking slot assembly 10 in an unlocked position. While the spring 32 shown is a coil spring, the spring 32 may be any biasing member. Likewise, the shear pin 30 may be a screw, spring, or any other shearable member. Air at atmospheric pressure may initially fill the fluid chamber 22. An electrically controlled propellant 15 may be placed in fluid chamber 22 as shown, or alternatively may be placed in a separate chamber (not shown) in communication with the fluid chamber 22. The electrically controlled propellant 15 may be provided in any amount suitable for the application of the tool 12, and may be provided in tool 12 in any form (e.g., solid or liquid), size, or shape that is suitable. An electrically conductive wire or cable 17 is also installed in the tool with one end in contact with the electrically controlled propellant 15. The other end of the wire or cable 17 may run from the tool up to the surface where it is connected with a source of electricity, or may be connected to another electrically conductive structure in the mandrel 14 or tool string to which the tool 12 is connected, which may be connected to a source of electricity.

When an electrical current is applied to the wire or cable 17, at least a portion of the electrically controlled propellant 15 may be ignited, causing a release of heat or gas and thus and increase in pressure within the fluid chamber 22. Once the pressure within fluid chamber 22 reaches a predetermined value, shear pins 30 are sheared and the lock 20 is allowed to move longitudinally with respect to the actuating mandrel 14, thus "unlocking" the locking slot assembly 10. The tool 12 is shown in the unlocked position in FIG. 1B after the electrically controlled propellant has been ignited. In other embodiments, mechanisms other than shear pins and springs may be used to temporarily retain the tool in the "locked" position, as will be recognized by a person of ordinary skill in the art with the benefit of this disclosure.

Figure 2A:
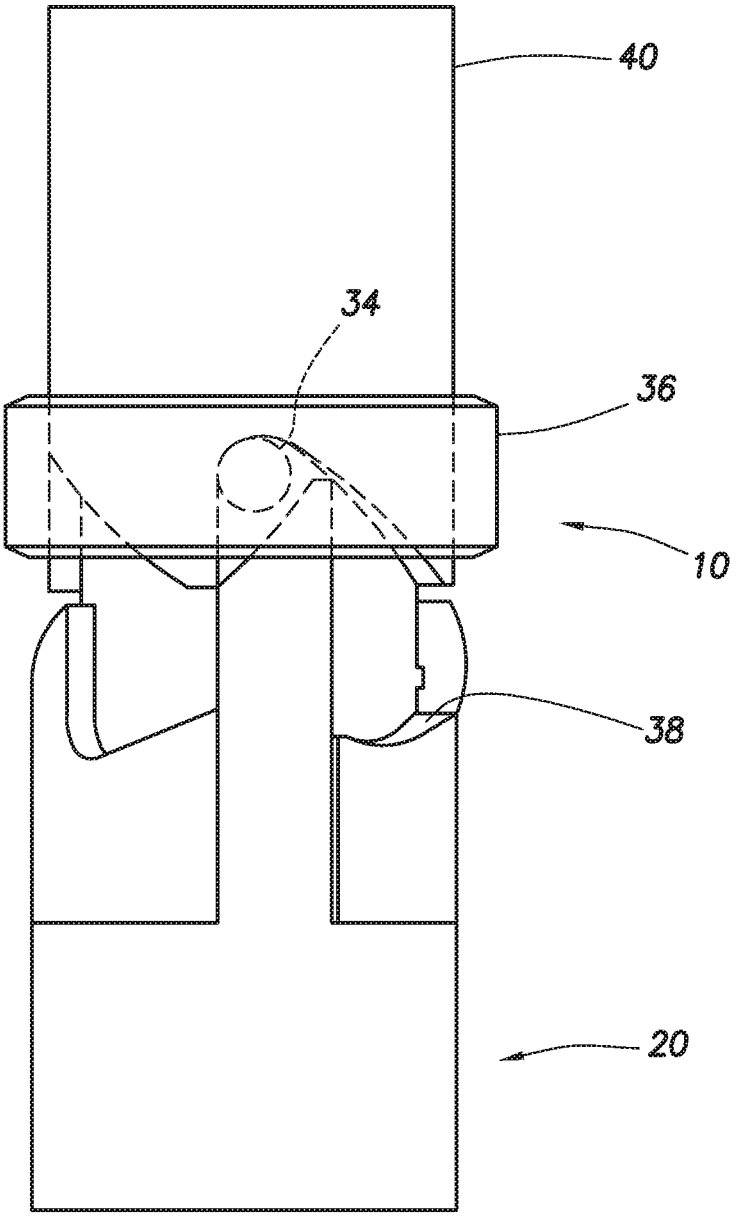
FIG. 2A is a diagram showing a side view of certain aspects of a tool according to certain embodiments of the present disclosure.
Figure 2B:
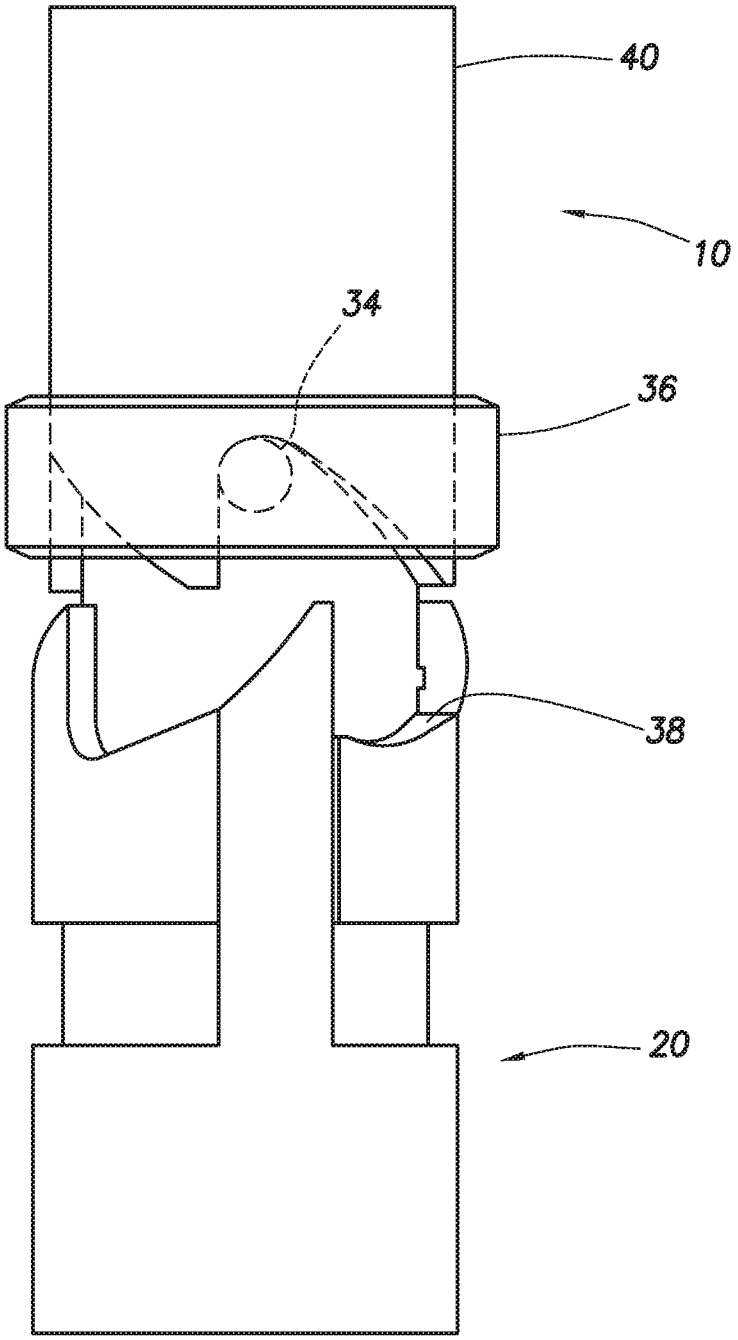
FIG. 2B is a diagram showing a side view of the aspects of the tool shown in FIG. 2A, showing an unlocked position.

FIGS. 2A and 2B, which will be discussed below, further show the locked position and unlocked position respectively. Referring now to FIGS. 2A and 2B, one or more lugs 34 may extend from a lug rotator ring 36 into a continuous slot 38 in a sleeve 40, thus providing locking assembly 10. As previously discussed, pressure may cause the lock 20 to become unlocked. In the locked position, a locking portion of the lock 20 occupies space within the slot 38, keeping the lugs 34 in a run-in-hole position, and preventing the lugs 34 from moving relative to the slot 38. As the lock 20 moves downwardly because of increased pressure, the locking portion moves out of the slot 38. When a tool such as the one shown is run into a well bore, the mandrel is held in the run-in-hole position by interaction of a lug with a J-slot. Once pressure is applied and the locking slot assembly 10 is unlocked (as shown in FIG. 1B), the locking slot assembly 10 may be actuated, allowing the lug rotator ring 36 to move longitudinally with respect to the sleeve 40. In other words, the tool 12 may be set by pushing downward on the tool string, which lowers lug 34. While any type of slot 38 may be used, the embodiment shown uses a j-slot, and in particular, shows a continuous J-slot. Depending on the specific application and the type of slot, setting the tool may involve pushing downward on the tool string multiple times. Thus, when a continuous j-slot is used, the tool 12 may be set by up and down motion alone. This may prevent the operator from cycling through the slot and setting the tool 12 prematurely.

In certain embodiments, a series of multiple tools such as tool 12 may be disposed in a well bore, but only certain of the tools may be selectively actuated or set by selectively igniting certain of the electrically controlled propellants therein. Moreover, a single tool may have multiple different mechanically actuatable components that can be selectively actuated by the selective ignition of certain electrically controlled propellants in that tool. Different types of electrically controlled propellants may be selectively ignited in a number of different ways. For example, multiple different types or amounts of electrically controlled propellants may be used in a single tool or series of tools that each requires different amounts of electrical current to ignite them. In those embodiments, the same electrical current may be applied to all of the tools or propellants in a tool, but in an amount that is sufficient to ignite certain of the propellants but not others. In other embodiments, one or more switches may be installed to selectively control the flow of electrical current to certain tools or components but not others in order to selectively ignite the propellant only in those tools or components.

Similar mechanisms including pressure chambers may be used in various types of tools to actuate a number of other types of mechanical parts. For example, similar mechanisms may be used to set or unset a tool in a well bore, open or close passageways or valves within a tool, open or close (or otherwise move) a sliding sleeve assembly, and/or the like. In some embodiments, the mechanisms actuated may be bi-directional or multi-directional, such that it can be actuated to any of its configurations or positions, for example, by igniting the electrically-controlled propellant. One example of such a bi-directional configuration includes the J-slot mechanism shown in FIGS. 2A and 2B in which the repeated ignition of the propellant (e.g., by re-applying electrical current to the propellant multiple times) may allow the slot assembly to toggle, cycle, or otherwise alternate between its two different positions. In other embodiments, a method or system of the present disclosure may use tools having other types of configurations such as opposable switch configurations, sliding piston configurations, and the like that can be toggled or cycled through two or more different positions.

Figure 3:
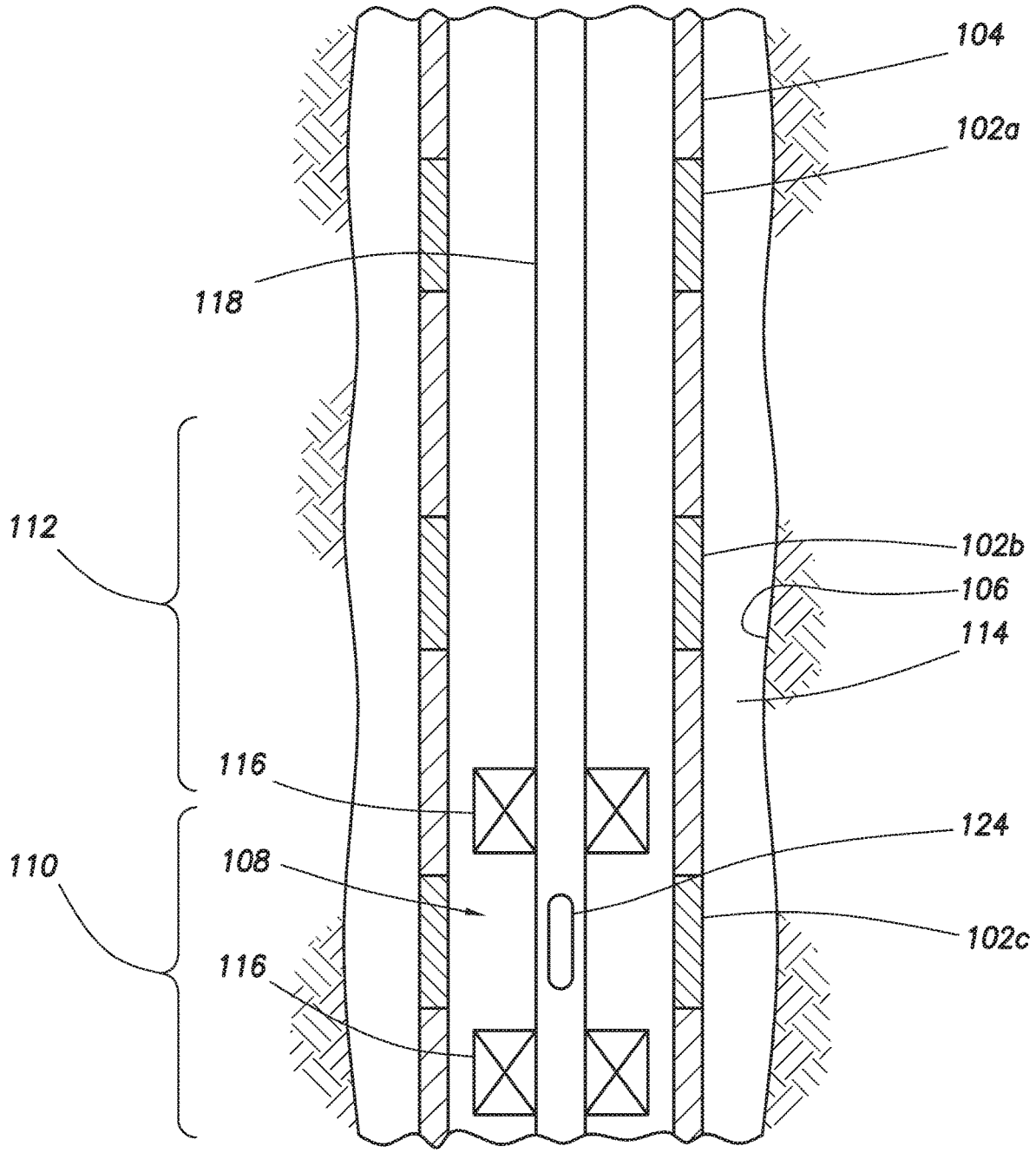
FIG. 3 is a diagram illustrating a side view of an example of a system according to certain embodiments of the present disclosure disposed in a subterranean well bore.
Figure 4A:
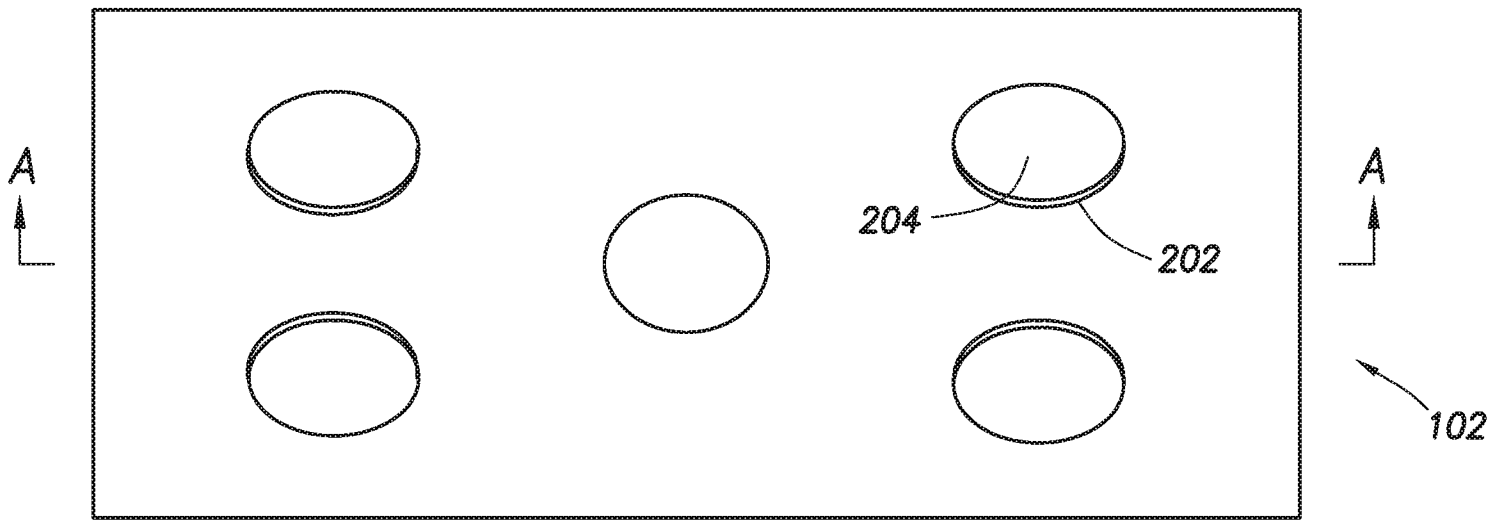
FIGS. 4A and 4B are diagrams showing a side view and cross-sectional side view, respectively, of a tool according to certain embodiments of the present disclosure.
Figure 4B:
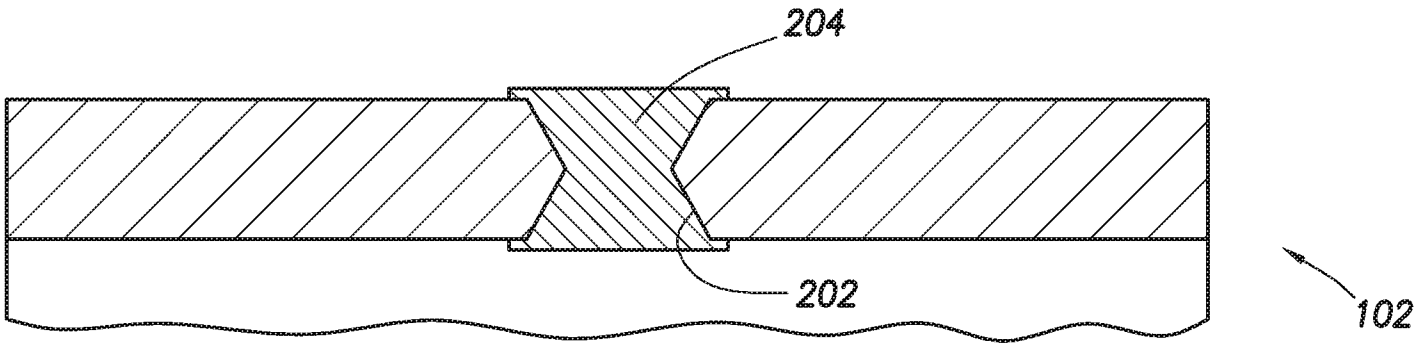

Another example of a tool of the present disclosure that includes an electrically-controlled propellant may include a pre-perforated sub assembly that may be installed in a well bore. Certain aspects of these embodiments are shown in FIGS. 3, 4A, and 4B. Referring now to FIG. 3, a well bore 106 that penetrates one or more intervals (e.g., first interval 110 and/or second interval 112) in a subterranean formation is shown. A tubing 118 and bottomhole assembly 108 have been installed in the well bore 106, with a liner 104 installed around the tubing 118 and bottomhole assembly 108. As shown, one or more pre-perforated subs 102 (illustrated in FIGS. 4A and 4B) have been installed in the liner 104 at pre-determined locations. This system may be used in performing one or more operations (e.g., fracturing) in one or more intervals (e.g., first interval 110 and/or second interval 112) in the formation proximate to the pre-perforated subs 102. In some embodiments, deepest or intervals may be treated before more shallow intervals. However, the different intervals may be treated in any order, depending on the particular conditions present. Some embodiments may additionally include a step of installing a depth correlation device or an interval locator (not shown) on liner 104 prior to running liner 104 into wellbore 106.

Referring now to FIG. 4A, an example of a pre-perforated sub 102 of the present disclosure is illustrated. Sub 102 may have one or more perforations 202, at least one of which is filled with a filling material 204 that comprises an electrically controlled propellant. Filling material 204 may consist solely of an electrically controlled propellant of the present disclosure, or may comprise a mixture of an electrically controlled propellant with another type of material, including but not limited to cement, fiberglass, ceramic materials, carbon fibers, polymeric materials, sand, clay, combinations thereof, or any other suitable material. Alternatively, the electrically controlled propellant could be provided in discrete pellets or quantities embedded in another type of material. The number and size of perforations 202 may be determined by the treatment design for each particular wellbore 106. The filling material 204 in each perforations 202 of the sub 102 (or the ports 202 of multiple different subs 102*a*, 102*b*, and 102*c* shown in FIG. 3) may comprise the same material or different materials. Filling material 204 may partially fill, completely fill, or overfill perforations 202. FIG. 4B is a cross-sectional side view of sub 102 along line A, and illustrates filling material 204 overfilling perforations 202. The components of the filling material may be selected based on a number of factors, including but not limited to the fluids used in the treatment, the amount of electrical current needed and/or available to ignite the electrically controlled propellant in the filling material, the pressure or temperature conditions in the well bore, or other factors. In some embodiments, pre-perforated sub 102 may further comprise one or more electrically conductive wires or cables (not shown) having a portion or end in contact with the filling material 204 that comprises an electrically controlled propellant. The other end of such wires or cables may run from the sub up to the surface where it is connected with a source of electricity, or may connect to another electrically conductive structure in the sub or liner in which the sub is installed, which may be connected to a source of electricity. Such wires and cables may be run to the surface, or may be connected to other electrically conductive components in the sub or liner in which it is installed Referring back to FIG. 3, liner 104 may be secured in wellbore 106 by placing cement in annulus 114 formed between liner 104 and well bore 106 and allowing the cement to set, or by setting one or more packers (not shown) in annulus 114. The packers may be annular isolation packers, such as swell packers, or other isolation devices known to those having ordinary skill in the art. Once liner 104, including pre-perforated subs 102, has been deployed and/or secured, bottomhole assembly 108 may be run into the well bore 106 on tubing or coiled tubing or a combination string of jointed pipe and coiled tubing. Bottomhole assembly 108 may be deployed to fracture and stimulate individual fractures in any sequence. Bottomhole assembly 108 may include straddle packer 116 connected to tubing 118 via threaded connections, clamp-on connections, slip on connections, or any other suitable connection. Straddle packer 116 may include packer elements, including conventional solid packer-ring elastomers, cup-type elastomers, inflatable elastomers, or combinations thereof, or any other straddle assembly. As illustrated, in addition to straddle packer 116, bottomhole assembly 108 may include a fluid port 124 through which treatment fluids such as fracturing fluids may flow. Bottomhole assembly 108 may include one or more other components, including but not limited to hydraulic hold downs, centralizers, blast joint(s) for spacing, equalizing valves, and/or additional packers.

In certain embodiments of the present disclosure, the fluid port 124 may be run to a depth corresponding to a particular interval to be treated (e.g., interval 110) at which a pre-perforated sub of the present disclosure (e.g., sub 102*c*) has been installed. In order to access the desired interval 110 in the subterranean formation, one or more perforations in the pre-perforated sub 102*c* must be opened by at least partially removing the filling material from those perforations. This may be accomplished by applying an electrical current to a wire or cable in contact with the filling material (or to the liner or sub itself, if the liner and/or sub is made of electrically conductive material) to ignite the electrically controlled propellant therein, causing at least a portion of the filling material to burn, melt, break apart, or otherwise be removed. In certain embodiments, the perforations in only certain of subs 102*a*, 102*b*, and 102*c* (or only certain perforations in a particular sub) may be selectively opened. For example, the filling material in different perforations or subs in a single liner may comprise different amounts or types of electrically controlled propellant that require different amounts of electrical current to ignite them. In those embodiments, electrical current may be applied to all of the subs along a liner, but in an amount that is sufficient to ignite the propellant in certain of the subs or perforations but not others. In other embodiments, one or more switches may be installed to selectively control the flow of electrical current to certain subs or perforations but not others in order to selectively ignite the propellant only in those subs or perforations.

Once the perforations in the sub at the selected interval have been opened, the treatment fluid (e.g., a fracturing fluid) may be pumped into the well bore through the tubing, exiting the tubing through a fluid port therein, and flowing through the open perforations in the pre-perforated sub into the selected interval of the formation. Additional intervals in the same well bore may be treated in a similar manner by moving the tubing and fluid port to the next interval to be treated (e.g., interval 112 as shown in FIG. 3), and opening the perforations in pre-perforated sub 102*b* in a similar manner to that described above.

As noted above, an electrical current must be applied to the electrically controlled propellant to ignite it and actuate a tool of the present disclosure. That electrical current may be transmitted or otherwise provided to the downhole tool assembly using any means known in the art. In some embodiments, electrical current is provided from a direct current (DC) source, although electrical power from alternating current (AC) sources can be used as well. In some embodiments, the source of electrical current may be provided at the surface, and the current may be transferred via a conductive wire, cable, and/or tubing into the subterranean formation to the tool assembly where it is applied to the electrically controlled propellant. In these embodiments, the electrical current may pass through any number of secondary relays, switches, conduits (e.g., wires or cables), equipment made of conductive material (e.g., metal casings, liners, etc.) or other electrically conductive structures. In other embodiments, the electrical current also may be provided by some other downhole energy source (such as downhole charges, hydraulic power generators, batteries, or the like), and then applied to the electrically controlled propellant in the tool assembly. In certain embodiments, the amount of electrical current applied to ignite the electrically controlled propellant may range from about 10 milliamps to about 100 milliamps. In certain embodiments, the electrical current applied to ignite the electrically controlled propellant may have a corresponding voltage of from about 200V to about 600V.

The electrically controlled propellant may be ignited at any time, and the application of electrical current to the propellant may be triggered in any known way. In some embodiments, the current may be applied in response to manual input by an operator, either at the surface of the well site where the tool is installed or from a remote location. In other embodiments, the current may be applied automatically in response to the detection of certain conditions in the formation using one or more downhole sensors. Examples of downhole sensors that may be used in this way include, but are not limited to, pressure sensors, temperature sensors, water sensors, motion sensors, chemical sensors, and the like. For example, certain systems of the present disclosure may be configured to apply electrical current to electrically controlled propellants in a downhole safety valve in response to a sensor's detection of a bottomhole pressure in the well at or above a given level. As noted above, in certain embodiments, the electrically controlled propellant in a given tool may be re-ignited after it has been at least partially ignited in an earlier use. This re-ignition may be accomplished either manually or automatically using any known mechanisms for applying electrical current, including but not limited to the mechanisms described above. Where a propellant is re-ignited automatically in response to detection of certain conditions by a sensor, those conditions may be the same conditions as or different conditions from the conditions that initially triggered the ignition of the propellant.

The present disclosure in some embodiments provides methods and systems that may be used in carrying out a variety of subterranean operations, including but not limited to, drilling operations, workover operations, cementing operations, completions operations, stimulation operations (e.g., hydraulic fracturing treatments or acidizing treatments), well bore clean-up operations, and the like. The methods and systems of the present disclosure also may be used during periods when hydrocarbons or other fluids are being produced from a subterranean formation and/or well bore. The well bores in which the methods and systems of the present disclosure may be used may be cased holes or open holes, as well as partially cased or partially open holes. The well bores also may be vertical well bores or may comprise portions that are deviated or horizontal to any degree.

An embodiment of the present disclosure is a method comprising: providing a tool assembly that comprises a tool body and an electrically controlled propellant; and placing the tool assembly in at least a portion of a subterranean formation.

Another embodiment of the present disclosure is a downhole tool comprising: a tool body; an electrically controlled propellant disposed on the tool body; and an electrically conductive conduit having a first portion in contact with the electrically controlled propellant and a second portion connected to a source of electrical current.

Another embodiment of the present disclosure is a method comprising: providing a packer assembly that comprises a tool body that comprises at least one mechanically actuatable component, an electrically controlled propellant disposed on the tool body, and an electrically conductive conduit having a first portion in contact with the electrically controlled propellant and a second portion connected to a source of electrical current; placing the packer assembly in a well bore that penetrates at least a portion of a subterranean formation; applying an electrical current to at least a portion of the electrically controlled propellant to ignite the portion of the propellant; and allowing energy from ignition of the electrically controlled propellant to actuate the mechanical component and set the packer assembly in the well bore.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. While numerous changes may be made by those skilled in the art, such changes are encompassed within the spirit of the subject matter defined by the appended claims. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. In particular, every range of values (e.g., "from about a to about b," or, equivalently, "from approximately a to b," or, equivalently, "from approximately a-b") disclosed herein is to be understood as referring to the power set (the set of all subsets) of the respective range of values. The terms in the claims have their plain, ordinary meaning unless otherwise explicitly and clearly defined by the patentee.

What is claimed is:

1. A method comprising:

providing a tool assembly that comprises an electrically controlled propellant and a tool body, wherein the tool body comprises at least one actuatable mechanical component, wherein there is a locking slot assembly disposed at a lower end of the tool body, wherein the tool body further comprises a biasing member configured to bias the locking slot assembly in an unlocked position;

placing the tool assembly in at least a portion of a subterranean formation;

applying an electrical current to at least a portion of the electrically controlled propellant to ignite the portion of the propellant, wherein igniting the portion of the propellant increases the pressure within a fluid chamber;

allowing energy from ignition of the electrically controlled propellant to actuate the mechanical component; and actuating the locking slot assembly once the pressure within the fluid chamber reaches a predetermined value.

2. The method of claim 1 wherein the tool assembly is a packer or plug.

3. The method of claim 1 wherein the tool assembly comprises a sliding sleeve.

4. The method of claim 1 wherein the tool body comprises a pre-perforated sub that comprises a plurality of perforations disposed in the tool body, wherein one or more of the perforations are at least partially filled with a filling material that comprises the electrically controlled propellant.

5. The method of claim 4 wherein the filling material further comprises at least one material selected from the group consisting of: cement, fiberglass, ceramic materials, carbon fibers, polymeric materials, sand, clay, and any combination thereof.

6. The method of claim 1 further comprising:

ceasing the application of electrical current to at least a portion of the electrically controlled propellant; and after ceasing the application of electrical current, applying a second electrical current to at least a portion of the electrically controlled propellant to re-ignite the portion of the propellant.

7. The method of claim 1 wherein the portion of the subterranean formation comprises a well bore that penetrates the portion of the subterranean formation.

8. The method of claim 1 wherein the tool assembly further comprises an electrically conductive conduit having a first portion in contact with the electrically controlled propellant.

9. The method of claim 1 wherein the electrically controlled propellant comprises:

a binder selected from the group consisting of: polyvinyl alcohol, polyvinylamine nitrate, polyethanolaminobutyne nitrate, polyethyleneimine nitrate, any copolymer thereof, and any mixture thereof;

an oxidizer selected from the group consisting of: ammonium nitrate, hydroxylamine nitrate, and any mixture thereof; and a crosslinking agent.

10. A downhole tool that comprises:

a tool body, wherein the tool body comprises at least one actuatable mechanical component, wherein there is a locking slot assembly disposed at a lower end of the tool body, wherein the tool body further comprises a biasing member configured to bias the locking slot assembly in an unlocked position;

an electrically controlled propellant disposed on the tool body, wherein the electrically controlled propellant, when ignited, provides an energy source to operate the actuatable mechanical component, wherein the electrically controlled propellant is located in a fluid chamber in the tool body; and an electrically conductive conduit having a first portion in contact with the electrically controlled propellant and a second portion connected to a source of electrical current, wherein the electrically controlled propellant is configured to be ignited by applying the electrical current to at least a portion of the electrically controlled propellant through the electrically conductive conduit, wherein ignition of the electrically controlled propellant is configured to increase the pressure within the fluid chamber, wherein the locking slot assembly is configured to be actuated once the pressure within the fluid chamber reaches a predetermined value.

11. The downhole tool of claim 10 wherein the downhole tool comprises a sliding sleeve.

12. The downhole tool of claim 10 wherein the tool body comprises a pre-perforated sub that comprises a plurality of perforations disposed in the tool body, and one or more of the perforations are at least partially filled with a filling material that comprises the electrically controlled propellant.

13. The downhole tool of claim 10 wherein the electrically controlled propellant comprises:

a binder selected from the group consisting of: polyvinyl alcohol, polyvinylamine nitrate, polyethanolaminobutyne nitrate, polyethyleneimine nitrate, any copolymer thereof, and any mixture thereof;

an oxidizer selected from the group consisting of: ammonium nitrate, hydroxylamine nitrate, and any mixture thereof; and a crosslinking agent.

14. A method comprising:

providing a packer assembly that comprises:

a tool body that comprises at least one mechanically actuatable component, wherein there is a locking slot assembly disposed at a lower end of the tool body, wherein the tool body further comprises a biasing member configured to bias the locking slot assembly in an unlocked position;

an electrically controlled propellant disposed on the tool body, wherein the electrically controlled propellant is located in a fluid chamber in the tool body; and an electrically conductive conduit having a first portion in contact with the electrically controlled propellant and a second portion connected to a source of electrical current;

placing the packer assembly in a well bore that penetrates at least a portion of a subterranean formation;

applying an electrical current to at least a portion of the electrically controlled propellant to ignite the portion of the propellant, wherein igniting the portion of the propellant increases the pressure within the fluid chamber; and allowing energy from ignition of the electrically controlled propellant to actuate the mechanical component; and actuating the locking slot assembly once the pressure within the fluid chamber reaches a predetermined value and set the packer assembly in the well bore.

15. The method of claim 14 wherein the electrically controlled propellant comprises:

a binder selected from the group consisting of: polyvinyl alcohol, polyvinylamine nitrate, polyethanolaminobutyne nitrate, polyethyleneimine nitrate, any copolymer thereof, and any mixture thereof;

an oxidizer selected from the group consisting of: ammonium nitrate, hydroxylamine nitrate, and any mixture thereof; and a crosslinking agent.

16. The method of claim 1 wherein the electrical current is applied to at least a portion of the electrically controlled propellant in an amount of from about 10 milliamp to about 100 milliamps.

17. The method of claim 1 wherein the electrical current is applied to at least a portion of the electrically controlled propellant with a corresponding voltage of from about 200 volts to about 600 volts.

18. The method of claim 1, wherein the biasing member is a spring.

19. The downhole tool of claim 10, wherein the biasing member is a spring.

20. The method of claim 14, wherein the biasing member is a spring.

* * * * *